US008927889B2

(12) United States Patent
Liebetruth et al.

(10) Patent No.: US 8,927,889 B2
(45) Date of Patent: Jan. 6, 2015

(54) ELECTRIC SWITCH

(75) Inventors: Marc Liebetruth, Glienicke (DE); Katja Manthey, Berlin (DE)

(73) Assignee: Siemens Aktiengesellschaft, Munich (DE)

( * ) Notice: Subject to any disclaimer, the term of this patent is extended or adjusted under 35 U.S.C. 154(b) by 638 days.

(21) Appl. No.: 13/215,263

(22) Filed: Aug. 23, 2011

(65) Prior Publication Data

US 2012/0048696 A1 Mar. 1, 2012

(30) Foreign Application Priority Data

Aug. 24, 2010 (DE) ..... 10 2010 035 571

(51) Int. Cl.
*H01H 3/00* (2006.01)
*H01H 3/02* (2006.01)

(52) U.S. Cl.
CPC ..... *H01H 3/022* (2013.01)
USPC ..... 200/338

(58) Field of Classification Search
CPC ..... H01H 3/022; H01H 3/54; H01H 3/08; H01H 15/02; H01H 19/14; H01H 21/18; G05G 1/12
USPC ..... 200/338, 61.54, 61.76, 293, 200/50.32–50.4, 400, 401, 500, 501, 303, 200/296, 530
See application file for complete search history.

(56) References Cited

U.S. PATENT DOCUMENTS 1,939,737 A 12/1933 Thomson
5,302,786 A * 4/1994 Rosen et al. ..... 200/400
5,323,131 A 6/1994 Castonguay
5,693,923 A * 12/1997 Gula et al. ..... 200/50.26
5,905,239 A * 5/1999 Turner et al. ..... 200/330
6,072,132 A * 6/2000 Turner ..... 200/330

FOREIGN PATENT DOCUMENTS

| | | |
|---|---|---|
| CH | 417 735 | 7/1966 |
| CN | 2417562 Y | 1/2001 |
| DE | 26 46 139 | 4/1977 |
| DE | 697 04 818 | 1/2002 |
| DE | 101 29 505 | 10/2002 |
| EP | 0 036 027 | 9/1981 |
| FR | 2 444 191 | 7/1980 |
| GB | 2 038 978 | 7/1980 |
| GB | 2 376 799 | 12/2002 |
| WO | WO 97/34310 | 9/1997 |

OTHER PUBLICATIONS

Office Action dated Jan. 25, 2012, in corresponding German Patent Application No. 10 2010 035 571.2.
Chinese Office Action and English translation thereof dated Aug. 27, 2014.

* cited by examiner

*Primary Examiner* — Edwin A. Leon
(74) *Attorney, Agent, or Firm* — Harness, Dickey & Pierce, P.L.C.

(57) ABSTRACT

An electrical switch with an at least two-part housing is disclosed, with a first housing part and second housing part connected to the first housing part, and with the first housing part including a connecting section for connection of a motor drive. In at least one embodiment, the switch includes at least one connecting screw which includes a first thread joining together the first and the second housing part and, on a screw end section facing away from the second housing part, includes a second thread projecting from the first housing part, onto which the motor drive can be screwed indirectly or directly.

16 Claims, 4 Drawing Sheets

ELECTRIC SWITCH

PRIORITY STATEMENT

The present application hereby claims priority under 35 U.S.C. §119 on German patent application number DE 10 2010 035 571.2 filed Aug. 24, 2010, the entire contents of which are hereby incorporated herein by reference.

FIELD

At least one embodiment of the invention generally relates to an electrical switch.

BACKGROUND

A typical electrical switch available on the market has a two-part housing with a first and a second housing part. The first housing part forms an upper housing part of the housing and the second housing part forms a lower housing part. The two housing parts are each made of plastic and are connected to one another.

The first housing part, i.e. the upper housing part, has a connecting section onto which an adapter can be screwed for connecting a motor drive. To fasten the adapter screws are screwed into the first housing part, i.e. into the plastic material, by which the adapter is fastened to the first housing part. The motor drive is subsequently fastened to the adapter. If no motor drive is to be used with the previously known switch, a device front cover can be placed instead on the upper housing in place of the motor drive.

SUMMARY

In at least one embodiment of the invention, an electrical switch is specified which is better able than conventional switches to support motor drives, especially heavy motor drives.

Advantageous embodiments of the inventive switch are specified in the subclaims.

BRIEF DESCRIPTION OF THE DRAWINGS

The invention is explained below in greater detail with reference to example embodiments, in which.

For the sake of clarity the same reference characters are always used in the figures for identical or comparable components.

DETAILED DESCRIPTION OF THE EXAMPLE EMBODIMENTS

Figure 1:
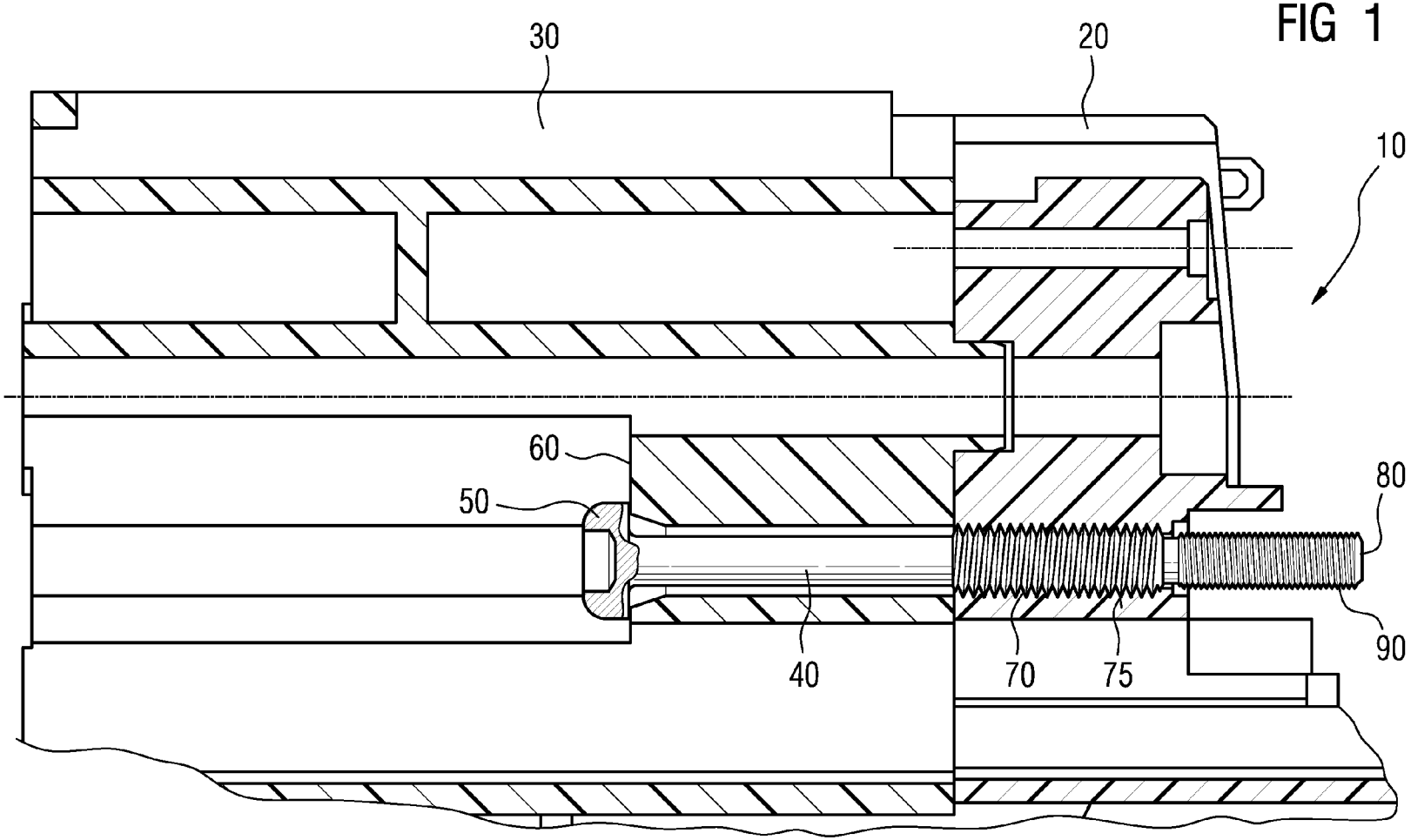
FIG. 1 shows an example embodiment for an inventive low-voltage switch with a first and a second housing part, before installation of an adapter and a motor drive.

Various example embodiments will now be described more fully with reference to the accompanying drawings in which only some example embodiments are shown. Specific structural and functional details disclosed herein are merely representative for purposes of describing example embodiments. The present invention, however, may be embodied in many alternate forms and should not be construed as limited to only the example embodiments set forth herein.

Accordingly, while example embodiments of the invention are capable of various modifications and alternative forms, embodiments thereof are shown by way of example in the drawings and will herein be described in detail. It should be understood, however, that there is no intent to limit example embodiments of the present invention to the particular forms disclosed. On the contrary, example embodiments are to cover all modifications, equivalents, and alternatives falling within the scope of the invention. Like numbers refer to like elements throughout the description of the figures.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of example embodiments of the present invention. As used herein, the term "and/or," includes any and all combinations of one or more of the associated listed items.

It will be understood that when an element is referred to as being "connected," or "coupled," to another element, it can be directly connected or coupled to the other element or intervening elements may be present. In contrast, when an element is referred to as being "directly connected," or "directly coupled," to another element, there are no intervening elements present. Other words used to describe the relationship between elements should be interpreted in a like fashion (e.g., "between," versus "directly between," "adjacent," versus "directly adjacent," etc.).

The terminology used herein is for the purpose of describing particular embodiments only and is not intended to be limiting of example embodiments of the invention. As used herein, the singular forms "a," "an," and "the," are intended to include the plural forms as well, unless the context clearly indicates otherwise. As used herein, the terms "and/or" and "at least one of" include any and all combinations of one or more of the associated listed items. It will be further understood that the terms "comprises," "comprising," "includes," and/or "including," when used herein, specify the presence of stated features, integers, steps, operations, elements, and/or components, but do not preclude the presence or addition of one or more other features, integers, steps, operations, elements, components, and/or groups thereof.

It should also be noted that in some alternative implementations, the functions/acts noted may occur out of the order noted in the figures. For example, two figures shown in succession may in fact be executed substantially concurrently or may sometimes be executed in the reverse order, depending upon the functionality/acts involved.

Spatially relative terms, such as "beneath", "below", "lower", "above", "upper", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors used herein are interpreted accordingly.

Although the terms first, second, etc. may be used herein to describe various elements, components, regions, layers and/or sections, it should be understood that these elements, components, regions, layers and/or sections should not be limited by these terms. These terms are used only to distinguish one element, component, region, layer, or section from another region, layer, or section. Thus, a first element, component, region, layer, or section discussed below could be termed a second element, component, region, layer, or section without departing from the teachings of the present invention.

FIG. 1 is a cross-sectional view of a section of a low voltage switch 10 not shown in any further detail. The figure shows a first housing part 20 that forms an upper housing part of the low-voltage switch 10 and also a second housing part 30 that forms a lower housing part of the low-voltage switch 10. The two housing parts 20 and 30 are preferably made of plastic.

In addition FIG. 1 shows a connecting screw 40, which is preferably made of metal.

The connecting screw 40 has a screw head 50 which is in contact with an outer side 60 of the second housing part 30 facing away from the first housing part 20.

The connecting screw 40 is also equipped in a central screw section with a first thread 70 which is screwed into the first housing part and thus screws the first housing part 20 firmly onto the second housing part 30.

To make this screw connection possible the diameter of the through-hole for the connecting screw 40 in the second housing part 30 is preferably at least as big as the diameter of the connecting screw 40, so that the connecting screw 40 can be pushed through the through-hole in the second housing part 30. An internal thread 75 is preferably embodied in the first housing part 20 into which the first thread 70 is screwed, which connects the two housing parts to one another. The internal thread 75 can be cut or formed by the connecting screw 40 in the first housing part 20 when the screw is screwed in alternately it can already be present before assembly, for example the internal thread can be made during the manufacturing of the first housing part 20 (for example by injection molding).

In addition the connecting screw 40 has an end section 80 which faces away from the second housing part 30 and protrudes from the first housing part 20. This screw end section 80 is equipped with a second thread 90 onto which a connection nut is able to be screwed for example.

FIG. 2 once again shows the two housing parts 20 and 30 as well as the connecting screw 40 after an adapter 110 has been screwed onto the screw end section 80 or onto the second thread 90 by way of a nut 100. The adapter 110 can typically be an adapter frame or an adapter plate. For reasons of stability the adapter is preferably made of metal.

Figure 2:
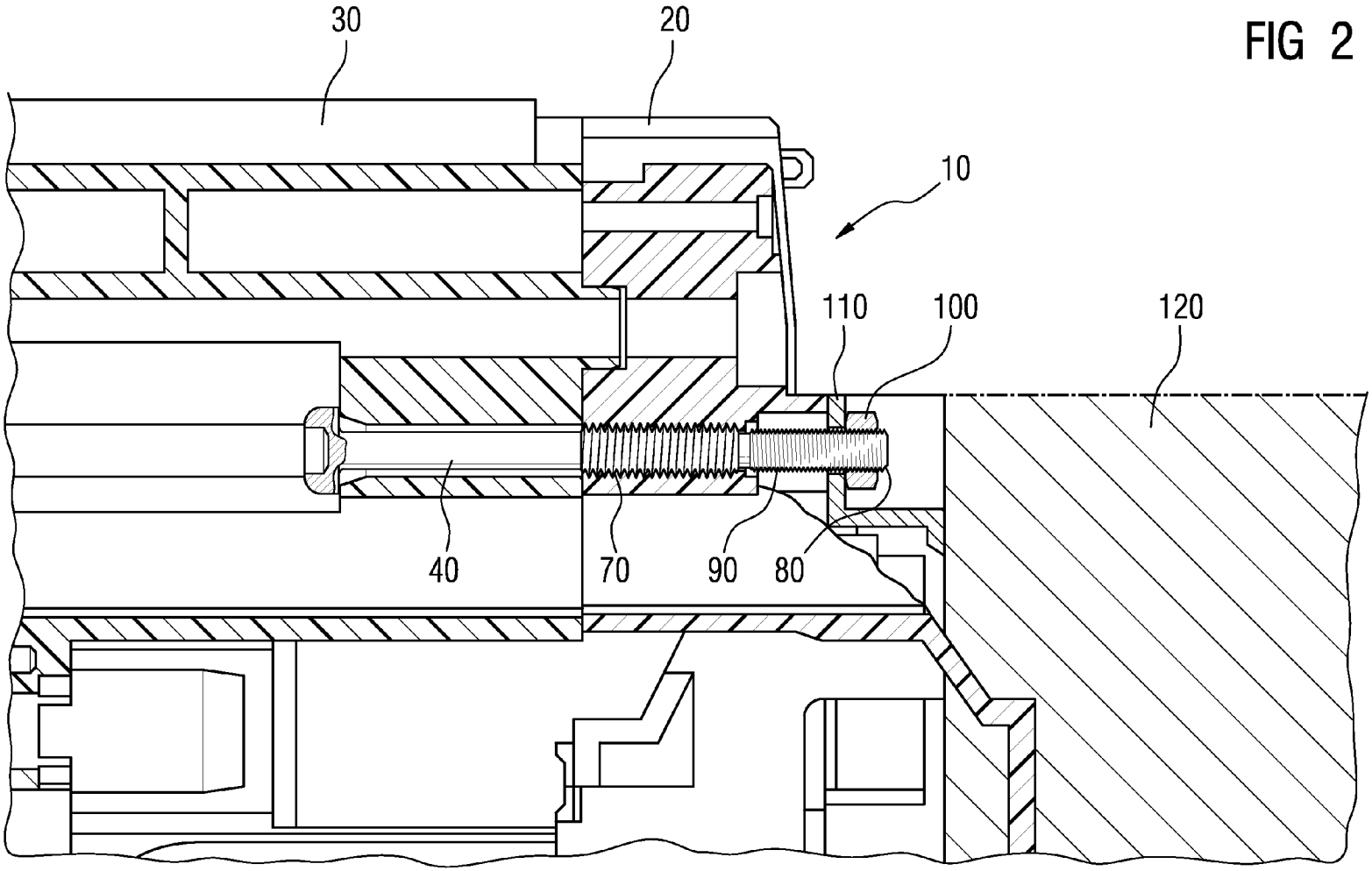
FIG. 2 shows the low-voltage switch in accordance with FIG. 1 after installation of an adapter and a motor drive in a detailed diagram.

It can also be seen from FIG. 2 that a motor drive 120 is attached to the adapter 100. The motor drive 120 is preferably screwed onto the adapter 110 by screws not shown in any greater detail. The adapter 110 is preferably equipped with the appropriate threads for this purpose, into which these screws are able to be screwed. As an alternative or in addition the motor drive 120 can be snapped, glued, pushed onto or attached in some other way to the adapter 110.

Figure 3:
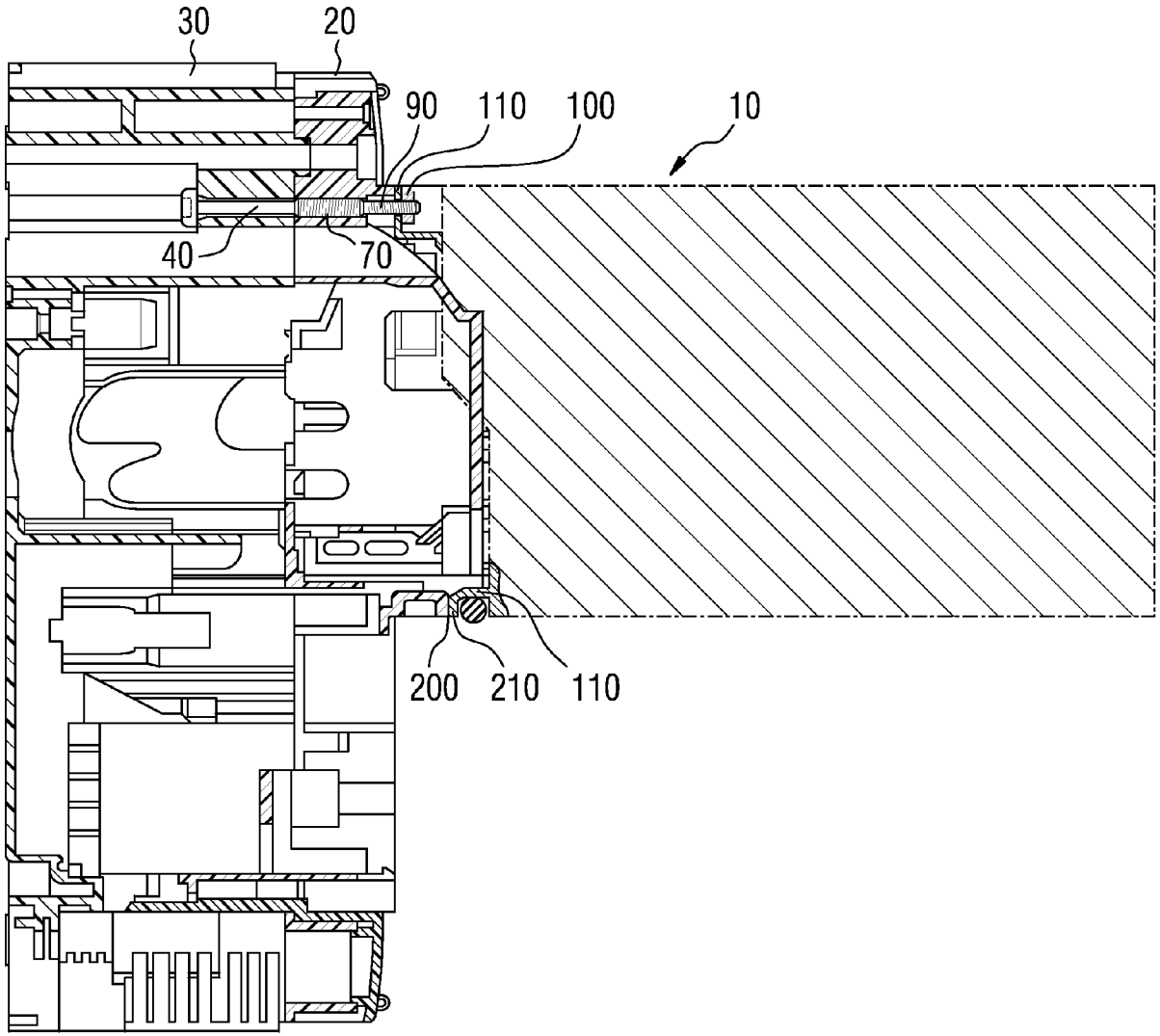
FIG. 3 shows the complete low-voltage switch in accordance with FIG. 2 after installation of the adapter and the motor drive and FIG. 4 shows an example embodiment for a connecting screw in detail.

FIG. 3 also shows a cross-sectional view of the complete low-voltage switch 10. The two housing parts 20 and 30 as well as the connecting screw 40 can be seen, of which the first thread 70 connects the two housing parts 20 and 30 to each other. The figure also shows the nut 100 by which the adapter 110 is screwed onto the upper housing part 20.

For further attachment of the adapter 110, the first housing part 20 as well as the adapter 110 preferably have one or more further mechanical interfaces. In the example embodiment in accordance with FIG. 3 the first housing part 20 is equipped with a mechanical interface 200 in the form of a recess which interacts with a mechanical interface 210 of the adapter 110.

The mechanical interface 210 takes the form of a hook and can thus be hooked into the mechanical interface 200 in the form of the recess. The two mechanical interfaces 200 and 210 thus form a hook connection through which the adapter is hooked onto the first housing part 20. As an alternative the mechanical interface 210 can also form a recess and the mechanical interface 200 a hook.

In summary, it can be said that in the example embodiment in accordance with FIGS. 1 through 3, the adapter 110 is screwed onto the connecting screw 40 by way of a nut 100 and is hooked onto the first housing part 20 by way of a hook connection.

The inclusion of the connecting screw 40 which connects the two housing parts 20 and 30 allows a permanently stable joining of the motor drive 120 to the first housing part 20 to be achieved, although said part is made of plastic, i.e. a material not able to withstand stress over the long term.

If, in the example embodiment in accordance with FIGS. 1 through 3, no motor drive 120 is to be used, a device front cover can be placed instead of said drive onto the first housing part 20 and attached.

Figure 4:
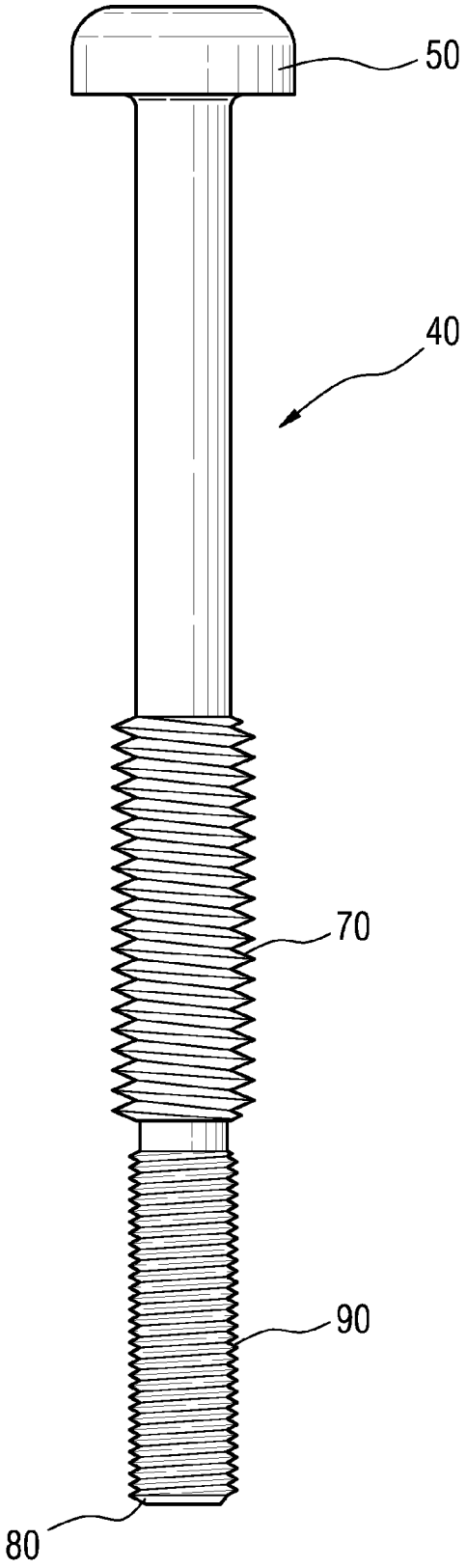

In FIG. 4 an example embodiment for the connecting screw 40 is shown in greater detail, the screw head 50, the first thread 70 in the central area of the connecting screw 40, the screw end section 80 and the second thread 90 can be seen in the figure. The two threads 70 and 90 preferably run in opposite directions.

The first thread 70 preferably involves a thread-forming or thread cutting section of the connecting screw 40 for screwing into plastic. The second thread 80 preferably involves a metric thread.

Accordingly there is inventive provision, in at least one embodiment, for the switch to feature at least one connecting screw having a first thread connecting the first and the second housing part and on an end section of the screw facing away from the second housing part, to have a second thread projecting from the first housing part, onto which the motor drive can be screwed indirectly or directly.

An advantage of at least one embodiment of the inventive switch is to be seen in the fact that the indirect or direct attachment of the motor drive to the first housing part is made by a connecting screw which has a double function: On the one hand the connecting screw connects the two housing parts and on the other it serves to attach the motor drive indirectly or directly. The provision of separate attachment screws, as is the case with known switches described at the outset, is thus not necessary.

A further advantage of at least one embodiment of the inventive switch can be seen in the fact that the attachment is not based on a screw screwed into plastic but instead uses the second thread projecting from the first housing part, so that a greater support capability than with the known switches is permanently achieved. It is known that the stability and support capability of plastic screws deteriorates over time so that the plastic screw connection provided in the known switches can only guarantee limited retaining force during long-term stresses. This is the starting point of the invention, in that inventively no screws are screwed into the first housing part but instead the inventively provided connection screw is used with which the two housing parts are screwed to one another. This double use of the connection screw makes it possible to transfer the flow of force from the first housing part to which the motor drives are attached indirectly or directly into the second housing part and thereby to screw the motor drive not only to the first housing part but also simultaneously to the second housing part. A permanently improved support capability is thus achieved compared to the situation with known electrical switches.

In order to guarantee especially great retaining forces over the long term, it is viewed as advantageous for the connection screw to have a screw head which is in contact with the outer side of the second housing part facing away from the first housing part. In this way the retaining force necessary to hold the motor drive is also at least applied by the screw head which is in contact with the outer side of the second housing part.

Preferably the first and the second thread are embodied to run in opposing directions: if the first thread is a right-hand thread (rising to the right) then the second thread is a left-hand thread (rising to the left); and if the first thread is a left-hand thread (rising to the left) then the second thread is preferably a right-hand thread (rising to the right). Such a choice of thread ensures that the two housing parts are screwed even more tightly together when the motor drive is screwed directly or indirectly onto the screw end section. As an alternative the first and second thread can also run in the same direction (i.e. both rising to the right or both rising to the left); in this case it is viewed as advantageous for the clamping moment between the first thread and the first housing part to be greater than the maximum tightening moment between the second thread and the mating piece, (e.g. adapter, motor drive, device front cover etc.) screwed onto said thread.

For indirect attachment of the motor drive an adapter can be provided for example, which is screwed onto the second thread of the connecting screw and makes it possible to attach the motor drive to the adapter. The adapter can for example involve an adapter frame or an adapter plate. Especially preferably the adapter is made of metal to enable it to transmit especially large forces.

The motor drive can typically be attached to the adapter by one or more screws which are screwed into the adapter. Preferably the adapter has one or more corresponding threaded holes for this purpose.

To screw the adapter onto the connecting screw projecting from the first housing part a nut can be provided for example, which is screwed onto the second thread of the connecting screw.

In addition the first housing part can have a mechanical interface which can be hooked onto the mechanical interface of the adapter or the motor drive. Such a mechanical interface can be formed in the first housing part for example by a recess into which a hook forming the mechanical interface of the adapter or of the motor drive is hooked. As an alternative the mechanical interface of the first housing part can also be formed by a hook, which engages into a recess of the adapter or of the motor drive forming a mechanical interface of the adapter or of the motor drive.

The first housing part preferably forms an upper housing part of the housing and the second housing part preferably forms a lower housing part of the housing of the electrical switch.

The first and the second housing part are preferably made of plastic.

In another embodiment of the electrical switch, there is provision for the first housing part to be made of plastic and to form an upper housing part of the housing, for the second housing part to be made of plastic and form a lower housing part of housing, for the connecting screw in a center section of the screw to screw together the upper housing part and the lower housing part, for the connecting screw to have a screw head which is in contact with the underside of the lower housing part, for the second thread to project from the first upper housing part and for an adapter to be screwed onto the second thread with a nut and for the motor drive to be screwed onto the adapter with at least one screw. As an alternative or in addition the motor drive can be snapped onto or clamped onto the adapter by way of a snap-fit and/or clamp connection.

The patent claims filed with the application are formulation proposals without prejudice for obtaining more extensive patent protection. The applicant reserves the right to claim even further combinations of features previously disclosed only in the description and/or drawings.

The example embodiment or each example embodiment should not be understood as a restriction of the invention. Rather, numerous variations and modifications are possible in the context of the present disclosure, in particular those variants and combinations which can be inferred by the person skilled in the art with regard to achieving the object for example by combination or modification of individual features or elements or method steps that are described in connection with the general or specific part of the description and are contained in the claims and/or the drawings, and, by way of combinable features, lead to a new subject matter or to new method steps or sequences of method steps, including insofar as they concern production, testing and operating methods.

References back that are used in dependent claims indicate the further embodiment of the subject matter of the main claim by way of the features of the respective dependent claim; they should not be understood as dispensing with obtaining independent protection of the subject matter for the combinations of features in the referred-back dependent claims. Furthermore, with regard to interpreting the claims, where a feature is concretized in more specific detail in a subordinate claim, it should be assumed that such a restriction is not present in the respective preceding claims.

Since the subject matter of the dependent claims in relation to the prior art on the priority date may form separate and independent inventions, the applicant reserves the right to make them the subject matter of independent claims or divisional declarations. They may furthermore also contain independent inventions which have a configuration that is independent of the subject matters of the preceding dependent claims.

Further, elements and/or features of different example embodiments may be combined with each other and/or substituted for each other within the scope of this disclosure and appended claims.

Example embodiments being thus described, it will be obvious that the same may be varied in many ways. Such variations are not to be regarded as a departure from the spirit and scope of the present invention, and all such modifications as would be obvious to one skilled in the art are intended to be included within the scope of the following claims.

LIST OF REFERENCE CHARACTERS

10 Low-voltage switch
20 First housing part
30 Second housing part
40 Connecting screw
50 Screw head
60 Outer side
70 First thread
75 Inner thread
80 Screw end section

90 Second thread
100 Nut
110 Adapter
120 Motor drive
200 Interface
210 Interface

What is claimed is:

1. An electrical switch, comprising:

an at least two-part housing including a first housing part and a second housing part, the first housing part including a connecting section to connect a motor drive; and at least one connecting screw including a first thread connecting the first and the second housing part and, a second thread on a section of the at least one connecting screw at least partially projecting from the first housing part and separate from the first thread, onto which the motor drive is indirectly or directly screwable, wherein the first and the second housing part are plastic parts and wherein the first thread includes a cutting section for screwing into the plastic first and second housing parts.

2. The electrical switch as claimed in claim 1, wherein the connecting screw includes a screw head which is in contact with an outer side of the second housing part facing away from the first housing part.

3. The electrical switch as claimed in claim 1, wherein an adapter, to which the motor drive is attachable, is screwable onto the second thread.

4. The electrical switch as claimed in claim 3, wherein the adapter is formed by an adapter frame or an adapter plate.

5. The electrical switch as claimed in claim 1, wherein the first housing includes a mechanical interface, hookable onto a mechanical interface of the motor drive.

6. The electrical switch as claimed in claim 1, wherein the first housing part includes a recess into which a hook of the motor drive is hookable.

7. The electrical switch as claimed in claim 1, wherein the first housing part forms an upper housing part of the housing and the second housing part forms a lower housing part of the housing.

8. The electrical switch as claimed in claim 1, wherein the first housing part is a plastic part and forms an upper housing part of the housing, the second housing part is a plastic part and forms a lower housing part of the housing, the connecting screw, in a center screw section, screws together the upper housing part and the lower housing part, the connecting screw includes a screw head which is in contact with the lower side of the lower housing part, the second thread projects from the first upper housing part and an adapter is screwed onto a second thread with a nut and the motor drive is at least one of screwed onto the adapter with at least one screw and snapped on or clamped on by way of at least one of a snap-fit connection and a clamp connection.

9. The electrical switch as claimed in claim 3, wherein the first housing includes a mechanical interface, hookable onto a mechanical interface of the adapter or of the motor drive.

10. The electrical switch as claimed in claim 4, wherein the first housing includes a mechanical interface, hookable onto a mechanical interface of the adapter or of the motor drive.

11. The electrical switch as claimed in claim 3, wherein the first housing part includes a recess into which a hook of the adapter or of the motor drive is hookable.

12. The electrical switch as claimed in claim 4, wherein the first housing part includes a recess into which a hook of the adapter or of the motor drive is hookable.

13. The electrical switch as claimed in claim 2, wherein an adapter, to which the motor drive is attachable, is screwable onto the second thread.

14. The electrical switch as claimed in claim 13, wherein the adapter is formed by an adapter frame or an adapter plate.

15. The electrical switch as claimed in claim 1, wherein the first and second threads run in opposite directions.

16. The electrical switch as claimed in claim 1, wherein the first and second threads run in the same direction.

* * * * *